US008899173B2

(12) United States Patent
Ogasawara et al.

(10) Patent No.: US 8,899,173 B2
(45) Date of Patent: Dec. 2, 2014

(54) NOZZLE FOR ADHESIVE COATER

(75) Inventors: Yoshikazu Ogasawara, Kagawa (JP); Noriaki Ito, Kagawa (JP)

(73) Assignee: Unicharm Corporation, Ehime (JP)

( * ) Notice: Subject to any disclaimer, the term of this patent is extended or adjusted under 35 U.S.C. 154(b) by 402 days.

(21) Appl. No.: 13/320,154

(22) PCT Filed: Jun. 2, 2010

(86) PCT No.: PCT/JP2010/059321

§ 371 (c)(1),
(2), (4) Date: Jan. 25, 2012

(87) PCT Pub. No.: WO2010/143567

PCT Pub. Date: Dec. 16, 2010

(65) Prior Publication Data

US 2012/0111975 A1 May 10, 2012

(30) Foreign Application Priority Data

Jun. 8, 2009 (JP) ..... 2009-137664

(51) Int. Cl.
*B05C 5/02* (2006.01)
*B05B 13/02* (2006.01)
*B05B 1/14* (2006.01)

(52) U.S. Cl.
CPC ..... *B05C 5/025* (2013.01); *B05C 5/0254* (2013.01)
USPC ..... 118/325; 118/300; 239/555; 239/589; 239/590.5

(58) Field of Classification Search
USPC ..... 239/290, 296, 548, 554–557, 566, 589, 239/590.5; 118/300, 313, 315, 324, 325, 118/410–412; 427/207.1, 208.2
See application file for complete search history.

(56) References Cited

U.S. PATENT DOCUMENTS 4,687,137 A * 8/1987 Boger et al. ..... 239/124
4,735,169 A * 4/1988 Cawston et al. ..... 118/411

(Continued)

FOREIGN PATENT DOCUMENTS

DE 3506393 A1 8/1986
DE 3741074 A1 6/1989

(Continued)

OTHER PUBLICATIONS

Supplementary European Search Report issued Feb. 6, 2014, corresponds to European patent application No. 10786098.3.

(Continued)

*Primary Examiner* — Darren W Gorman
(74) *Attorney, Agent, or Firm* — Lowe Hauptman & Ham LLP

(57) ABSTRACT

A nozzle assembly configured to form one or more adhesive lines extending in a machine direction on an upper surface of a fibrous web continuously running in the machine direction has first, second and third working regions arranged in this order from upstream toward downstream in the machine direction. The first working region is adapted to come in close contact with the fibrous web fully in a width direction of the fibrous web. The second working region including first partitioning regions is arranged intermittently in a cross direction orthogonal to the machine direction and adhesive outlets each defined between each pair of the adjacent first partitioning regions. The third working region includes second partitioning regions arranged intermittently in the cross direction downstream of the first partitioning regions and stepped regions each defined between each pair of the adjacent second partitioning regions.

2 Claims, 7 Drawing Sheets

(56) References Cited

U.S. PATENT DOCUMENTS

| | | | | |
|---|---|---|---|---|
| 4,774,109 | A * | 9/1988 | Hadzimihalis et al. | 427/286 |
| 5,000,112 | A * | 3/1991 | Rothen et al. | 118/411 |
| 5,045,358 | A | 9/1991 | Watanabe et al. | |
| 5,083,526 | A * | 1/1992 | Rothen et al. | 118/411 |
| 5,145,528 | A | 9/1992 | Watanabe et al. | |
| 2004/0256496 | A1 * | 12/2004 | Harris et al. | 239/551 |
| 2006/0068113 | A1 * | 3/2006 | Aoyama et al. | 427/356 |
| 2007/0204793 | A1 | 9/2007 | Kufner et al. | |
| 2008/0145530 | A1 * | 6/2008 | Bondeson et al. | 427/207.1 |

FOREIGN PATENT DOCUMENTS

| | | | |
|---|---|---|---|
| JP | 62-091266 | A | 4/1987 |
| JP | 6-41869 | U | 6/1994 |
| JP | 08-229480 | A | 9/1996 |
| JP | 2616107 | B2 | 6/1997 |
| JP | 2004-229959 | A | 8/2004 |
| JP | 2004-249261 | A | 9/2004 |
| KR | 101155171 | B1 | 6/2012 |

OTHER PUBLICATIONS

International Search Report for PCT/JP2010/059321 mailed Sep. 14, 2010.

* cited by examiner

NOZZLE FOR ADHESIVE COATER

RELATED APPLICATIONS

The present application is National Phase of International Application Number PCT/JP2010/059321, filed Jun. 2, 2009 and claims priority from, Japanese Application Number 2009-137664, filed May 14, 2009.

TECHNICAL FIELD

The present invention relates to a nozzle assembly suitable to be used in coaters adapted to coat a fibrous web of such as a non-woven fabric, a woven fabric, paper, a plastic film or the like with adhesives such as hot melt adhesives.

BACKGROUND OF INVENTION

Conventionally, coaters are known which is provided for continuously coating a fibrous web, i.e., a web of a non-woven fabric or the like continuously running in a machine direction, with adhesives such as hot melt adhesives in a line pattern. For example, a nozzle used in such coater is disclosed in JP 2004-229959 A (PTL 1). The nozzle disclosed in PTL 1 includes a liquid supply channel in the middle as viewed in the machine direction and an air supply channel(s) upstream and/or downstream as viewed in the machine direction. In the step of coating a fibrous web with adhesives, the pointed tip of the nozzle is directed downward and put in contact with the fibrous web running beneath the nozzle in the machine direction. Adhesives having a viscosity in the range of 100 to 2000 cps are continuously supplied onto the surface of the fibrous web and simultaneously pressurized air is ejected through the air supply channel(s) to the fibrous web. According to the description of PTL 1, adhesives may accumulate on the nozzle tip and such accumulation may disturb a desirable condition of coated adhesives unless ejection of pressurized air is employed: while, ejection of pressurized air serves to prevent any amount of adhesives from accumulating on the tip of the nozzle and thereby to assure a stabilized condition of coated adhesives.

CITATION LIST

Patent Literature

{PTL 1} JP 2004-229959 A

SUMMARY OF INVENTION

Technical Problem

When coating a fibrous web of a non-woven fabric, paper, a plastic film or the like with hot melt adhesives by using the nozzle disclosed in PTL 1, particularly when drawing two or more lines of hot melt adhesives which are different from one another in width dimension, regions of the fibrous web kept in close contact with the tips of the respective nozzles are differentially tensed in the width direction depending on width dimensions of the associated nozzle orifices, and consequently, the condition of coated adhesives such as a basis mass and thickness of coated adhesives may become uneven. Even when the lines to be drawn with hot melt adhesives have the same width, it will be difficult to achieve the uniform condition of coated hot melt adhesives if the fibrous web has a thickness varying in the width direction of the fibrous web, i.e., the fibrous web includes a relatively thick region and a relatively thin region.

An object of the present invention is to provide a nozzle assembly improved so that, when drawing one or more adhesive lines, the nozzle assembly may facilitate the condition of coated adhesives to be equalized in one line and/or between the respective lines.

Solution to Problem

According to the present invention, there is provided a nozzle assembly composed of a series of plurality of nozzles incorporated in an adhesive coater to form an upper surface of a fibrous web continuously running in a machine direction with one or more adhesive lines extending in the machine direction.

The improvement according to the present invention is characterized as follows. The fibrous web has a length direction corresponding to the machine direction and a width direction corresponding to a cross direction orthogonal to the machine direction, and a side of the nozzle assembly facing the upper surface of the fibrous web is formed with first through third working regions in this order from upstream to downstream in the machine direction as described below in (1) through (3):

(1) the first working region adapted to be pressed against the fibrous web fully in the width direction;

(2) the second working region for discharge of adhesives including a plurality of first partitioning regions arranged intermittently in the cross direction and a plurality of adhesive outlets each defined between each pair of the adjacent first partitioning regions wherein the adhesive outlets are located corresponding to the adhesive lines to be formed in the cross direction and respective end surfaces of the first partitioning regions are flush with the first working region;

(3) the third working region including a plurality of second partitioning regions arranged intermittently in the cross direction downstream of the first partitioning regions having respective end surfaces thereof facing the upper surface of the fibrous web being flush with the first working region as well as with the end surfaces of the first partitioning regions and stepped regions each defined between each pair of the adjacent second partitioning regions and having a surface facing the upper surface of the fibrous web spaced upward at least 0.1 mm from the flush surfaces wherein the second partitioning regions and the stepped regions are alternately arranged in the cross direction.

According to one embodiment of the present invention, the nozzle assembly further includes a fourth working region for ejection of pressurized air downstream of the third working region wherein the fourth working region is defined downstream of the second partitioning regions and the stepped regions and has outlets from which the pressurized air is ejected toward the upper surface of the fibrous web.

According to another embodiment of the present invention, the nozzle assembly includes a first plate, a first shim, a second shim, a third shim and a second plate arranged separately in close contact with one another in this order from upstream to downstream in the machine direction; the first plate is formed with the first working region; the first shim is formed with the first partitioning regions and adhesive flow channels by trimming a metal plate used as material for the first shim so that the first shim cooperates with the first plate and the second shim both held in close contact with the first shim to define the adhesive outlets at respective ends of the adhesive flow channels; the third shim is formed with pressurized air flow channels by trimming a metal plate used as material for the third shim so that the third shim cooperates with the second shim and the second plate both held in close contact with the third shim to define the pressurized air outlets at respective ends of the pressurized air flow channels; the first plate is further formed with an adhesive guiding channel adapted to guide the adhesives from outside of the nozzle assembly into the adhesive flow channels; and the second plate is formed with a pressurized air guiding channel adapted to guide the pressurized air from outside of the nozzle assembly into the pressurized air flow channels.

According to still another embodiment of the present invention, the nozzle assembly includes a first plate, a shim and a second plate arranged separatably in close contact with one another in this order from upstream to downstream in the machine direction; the first plate is formed with the first working region and the adhesive flow channels; the shim is formed with the third working region; the second plate is formed with the pressurized air flow channels; the first plate and the shim held in close contact with each other to define the adhesive outlets; the second plate and the shim held in close contact with each other to define the pressurized air outlets; the first plate is further formed with an adhesive guiding channel adapted to guide the adhesive from outside of the nozzle assembly into the adhesive flow channels; and the second plate is formed with a pressurized air guiding channel adapted to guide the pressurized air from outside of the nozzle assembly into the pressurized air flow channels.

Advantageous Effect of Invention

The nozzle assembly according to the present invention includes on its upstream part a first working region adapted to come in close contact with a fibrous web running in the machine direction over full width thereof and thereby to tighten the fibrous web in the machine direction as well as in the cross direction. The adhesive outlets are located downstream of the first working region and therefore the fibrous web is already in such a tightened state when it is coated with the adhesives discharged from the adhesive outlets. The condition of adhesives coated in this manner is apt to be maintained uniformly regardless of the width dimension of the respective outlets. This is true even when thickness of the fibrous web is somewhat uneven in the cross direction.

DESCRIPTION OF EMBODIMENTS

Details of a nozzle assembly according to the present invention will be more fully understood from the description given hereunder with reference to the accompanying drawings.

Figure 1:
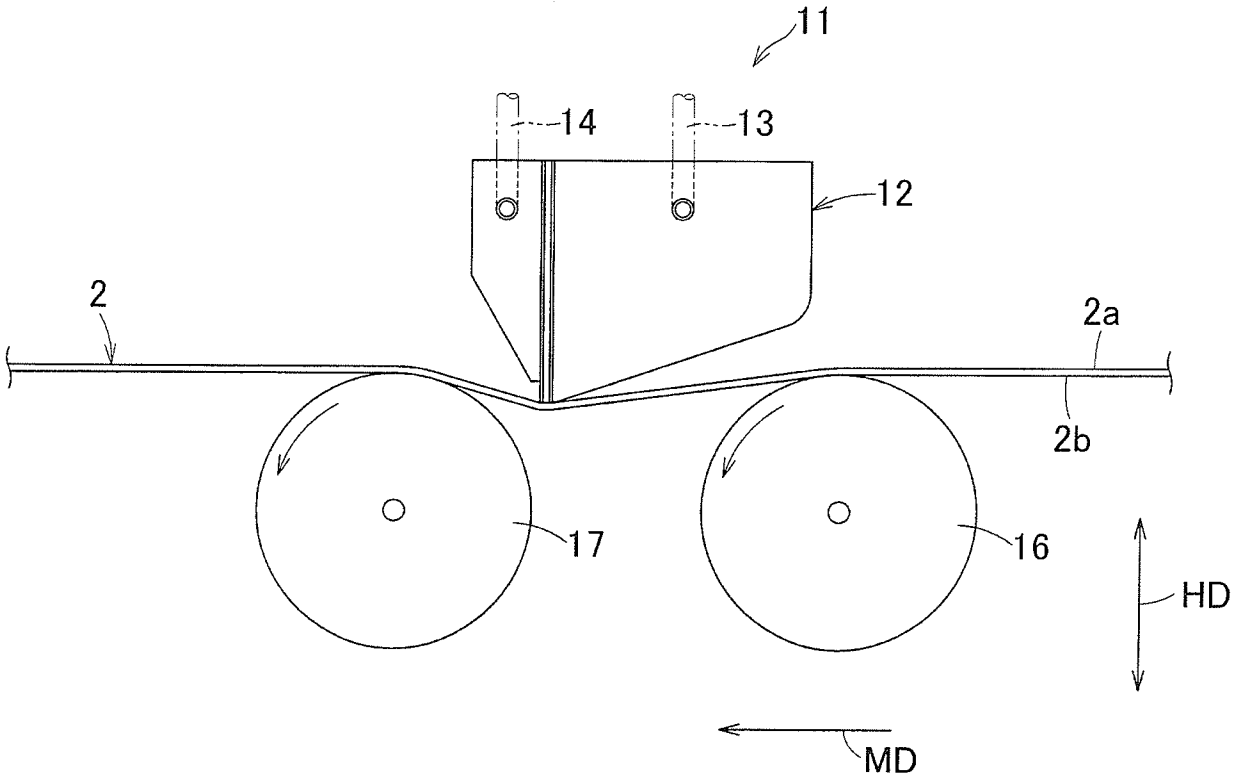
FIG. 1 is a side view of a coater including a nozzle assembly.
Figure 2:
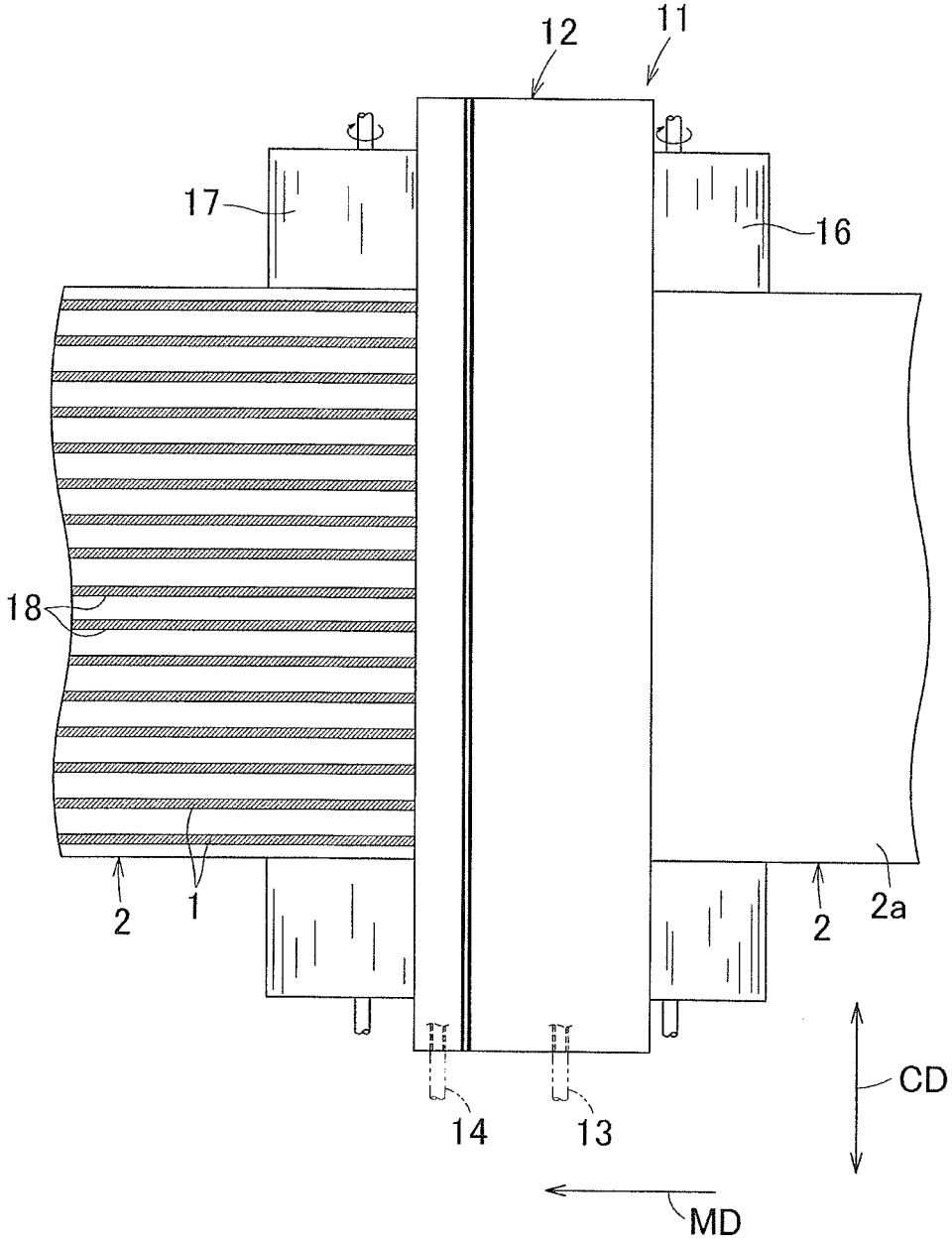
FIG. 2 is a top view of the coater including the nozzle assembly.

FIGS. 1 and 2 are a side view and an overhead view, respectively, showing a coater 11 used to coat an upper surface 2*a* of a fibrous web 2, i.e., a web of a non-woven fabric, with a hot melt adhesive 1. The coater 11 exemplarily illustrated is suitable, on a production line of wearing articles such as disposable diapers, disposable pants, menstruation napkins or disposable jackets, to be used for coating the fibrous web 2, for example, formed of a non-woven fabric having a width of 30 to 1000 mm and basis mass of 10 to 100 g/m$^2$, with the hot melt adhesive 1. The coater 11 includes a nozzle assembly 12, a pipe 13 adapted to supply the nozzle assembly 12 with the hot melt adhesive 1 in a molten state and a pipe 14 adapted to supply pressurized air. The pipe 13 and the pipe 14 are indicated by imaginary lines in FIGS. 1 and 2. FIGS. 1 and 2 further indicate a machine direction MD in which the fibrous web 2 runs, a cross direction CD corresponding to a width direction of the fibrous web 2 and extending orthogonally to the machine direction MD and a height direction HD extending orthogonally to these two directions by arrows and a double-headed arrow, respectively. Two supporting rollers 16, 17 are provided upstream and downstream of the nozzle assembly 12. The supporting rollers 16, 17 are located below a lower surface 2*b* of the fibrous web 2. At least one of these supporting rollers 16, 17 is movable upward and downward in the height direction HD and able to press the fibrous web 2 against the nozzle assembly 12 as seen in FIG. 1 as this roller moves upward and to space the fibrous web 2 from the nozzle assembly 12 by a predetermined dimension as this roller moves downward. The supporting rollers 16, 17 extend beyond both side edges of the fibrous web 2 in the cross direction CD. Referring to FIGS. 1 and 2, the fibrous web 2 is fed to the coater 11 from upstream as viewed in the machine direction MD, then coated by the coater 11 with the hot melt adhesive 1 to form two or more lines 18 of the hot melt adhesive 1 and runs further downstream in the machine direction MD. The fibrous web 2 is normally under tension in the machine direction MD and, in a region defined between the supporting roller 16 and the supporting roller 17, the fibrous web 2 is pressed against a lower end 20 (See FIGS. 3 and 4) of the nozzle assembly 12 and subject to further high tension in the machine direction MD as well as in the cross direction CD.

Figure 3:
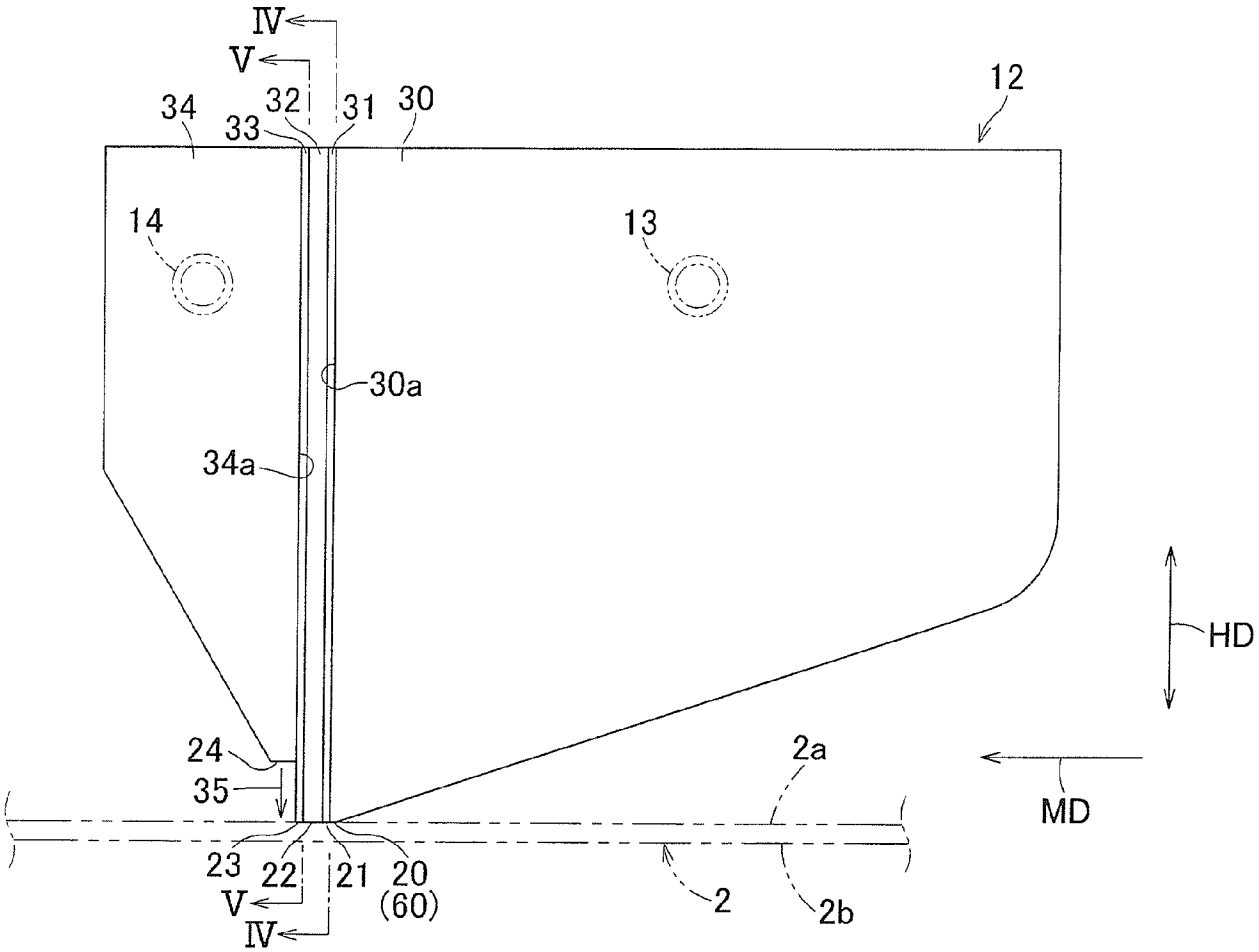
FIG. 3 is a scale-enlarged side view of the nozzle assembly.

FIG. 3 is a scale-enlarged side view of the nozzle assembly 12 wherein the fibrous web 2 is indicated by an imaginary line. The nozzle assembly 12 includes an upstream plate 30, a first shim 31, a second shim 32, a third shim 33 and a downstream plate 34 arranged in close contact with one another in this order from upstream toward downstream in the machine direction MD. These components 30, 31, 32, 33 and 34 are integrated one with another by bolts extending therethrough and nuts associated with these bolts (these bolts and nuts are not shown) so that these components may be separated one from another if desired. The upstream plate 30 is supplied with the hot melt adhesive 1 in molten state via pipe 13. A lower end 20 of the upstream plate 30 defines a contacting region 60 against which the fibrous web 2 running in the machine direction MD is pressed and this contacting region 60 is defined by a horizontal surface having a sufficient dimension in the cross direction CD to come in close contact with the fibrous web 2 over its entire width and a dimension in the machine direction MD preferably in the range of 1 to 5 mm. Referring to FIG. 3, respective lower ends 21, 22, 23 of the first, second and third shims 31, 32, 33 are flush with the lower end 20 of the upstream plate 30. The downstream plate 34 is supplied with pressurized air via pipe 14 and the pressurized air is ejected from the downstream plate 34 toward the fibrous web 2 as indicated by an arrow 35.

Figure 4:
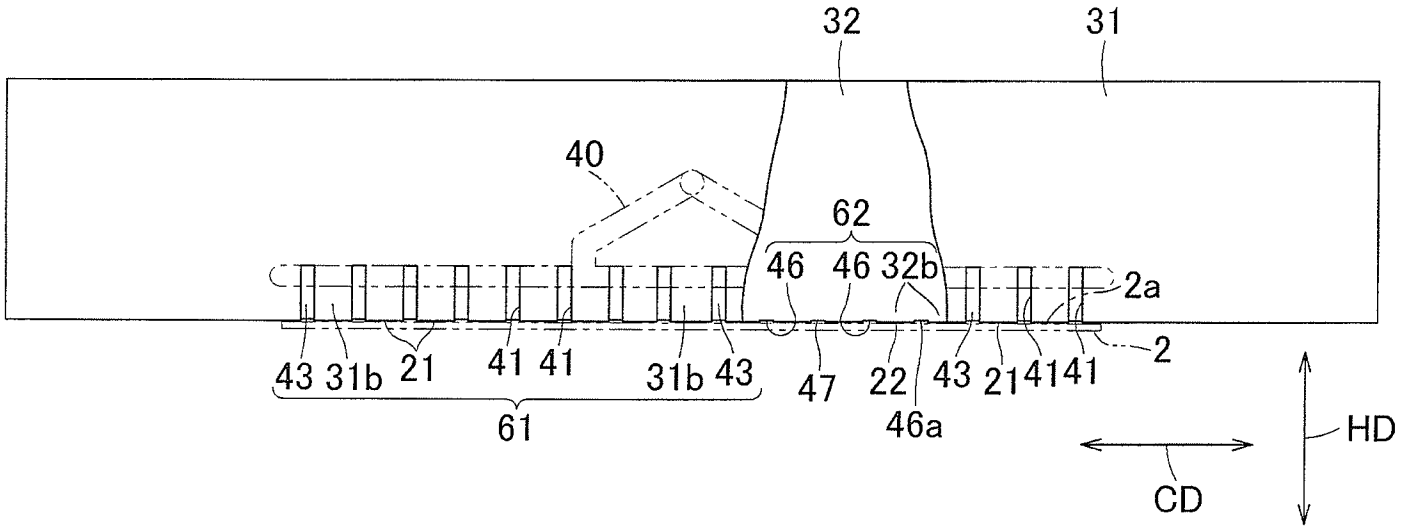
FIG. 4 is a sectional view taken along the line IV-IV in FIG. 3.

FIG. 4 is a partially cutaway sectional view taken along the line IV-IV in FIG. 3. The first shim 31 is sandwiched between the upstream plate 30 and the second shim 32 and may be formed by trimming a metallic plate into a desired shape. The first shim 31 has a plurality of adhesive flow channels 41 arranged in the cross direction CD at predetermined regular intervals, each pair of the adjacent adhesive flow channels 41 being spaced from each other by a first partitioning region 31*b* serving to define the predetermined interval and including the lower end 21. A flow channel 40 indicated by imaginary lines in the first shim 31 is a groove formed in a surface 30*a* (See FIG. 3) of the upstream plate 30 held in close contact with the first shim 31. The flow channel 40 is connected via an adhesive guiding channel (not shown) to the pipe 13 and, as seen in FIG. 4, intersects with the flow channels 41 so that the hot melt adhesive 1 may be guided from the pipe 13 to each of the flow channels 41. Respective ends of the flow channels 41 open downward and define respective outlets for the hot melt adhesive 1 with the first shim 31 being sandwiched between the upstream plate 30 and the second shim 32. Respective lower ends 21 of the first partitioning regions 31*b* are formed on a flat and smooth horizontal plane. In the first shim 31, these lower ends 21 of the first partitioning regions 31*b* cooperate with the lower ends 43 of the flow channels 41 to define an adhesive discharging region 61.

The second shim 32 partially shown in FIG. 4 is a rectangular plate-like component having a size substantially the same as the size of the first shim 31. Downstream of the respective first partitioning regions 31*b* of the first shim 31, the second shim 32 has second partitioning regions 32*b* associated with the respective first partitioning regions 31*b*. These second partitioning regions 32*b* respectively have lower ends 22 which are coplanar with the associated lower ends 21 of the first partitioning regions 31*b*. Downstream of the respective flow channels 41, the second shim 32 has stepped regions 46. The stepped region 46 controllably allows adhesive discharged in the first shim to pass therethrough in the machine direction MD and may be formed so that a width dimension in the cross direction CD and a height dimension in the height direction HD are equal to or larger than the width and height of a line 18 of the hot melt adhesive 1. It is also possible to form the stepped region 46 so that only the width dimension is equal to the width dimension of the line 18 or only the height dimension is equal to the height dimension of the line 18. The term "height of the line 18" may be reworded by "thickness of the line 18". According to one embodiment, the stepped region 46 has a height defined by a dimension measured from the lower end 22 to an uppermost surface 46*a* in the height dimension HD preferably at least of 0.1 mm and more preferably at least 0.2 mm and cooperates with the associated second partitioning region 32*b* to form a groove 47. The groove 47 opens downward in the height direction HD and has a length dimension depending on a thickness dimension corresponding to a dimension of the second shim in the machine direction MD. In the second shim 32, the second partitioning regions 32*b* and the stepped regions 46 alternately arranged in the cross direction CD to define an intermediate region 62 of the nozzle assembly 12 as viewed in the machine direction MD.

Within a space surrounded by the upstream plate 30, the first shim 31 and the second shim 32, the hot melt adhesive 1 supplied under pressure via the pipe 13 flows through the flow channel 40 into the respective channels 41 and, at the lower ends 43 of the respective flow channels 41, the upper surface 2*a* of the fibrous web 2 running under tension is linearly coated with the hot melt adhesive 1 (See FIG. 2). The hot melt adhesive 1 coated on the fibrous web 2 in this manner runs downstream together with the fibrous web 2 through the respective grooves 47. The hot melt adhesive 1 discharged downward onto the upper surface 2*a* of the fibrous web 2 from the lower ends 43 of the respective flow channels 41 is prevented by the upstream plate 30 which is present just upstream of the respective lower ends 43 from flowing upstream.

Figure 5:
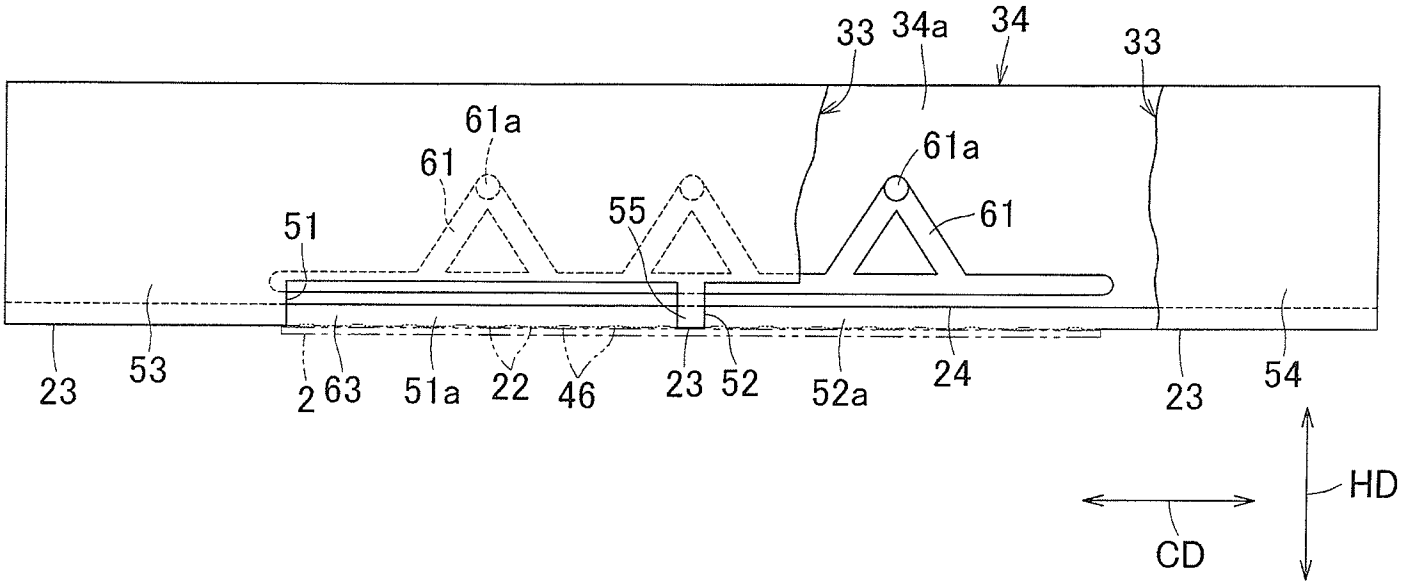
FIG. 5 is a sectional view taken along the line V-V in FIG. 3.

FIG. 5 is a partially cutaway sectional view taken along the line V-V in FIG. 3. Of the third shim 33 and the downstream plate 34 appearing in FIG. 5, the third shim 33 is sandwiched between the downstream plate 34 and the second shim 32. The third shim 33 may be obtained by trimming a metallic plate into a desired shape. The third shim 33 has a pair of air chambers 51, 52 symmetrically formed in the cross direction CD. The air chambers 51, 52 are provided at respective lower ends with openings 51*a*, 52*a* allowing ejection of pressurized air as indicated by an arrow 35 (See FIG. 3) toward the fibrous web 2. At a lateral part 53 of the air chamber 51, a lateral part 54 of the air chamber 52, and a middle part 55 defined between the air chambers 51, 52, the lower end 23 of the third shim 33 is flush with the lower end 20 of the upstream plate 30. FIG. 5 further indicates the lower end 22 and the stepped regions 46 of the second shim 32 which is held in close contact with third shim 33 by imaginary lines and indicates the fibrous web 2 also by an imaginary line.

The downstream plate 34 has pressurized air flow channels 61 cut in its surface 34*a* (See FIG. 3) held in close contact with the third shim 33 from the downstream side. The pressurized air flow channels 61 respectively include tubular segments 61*a* connected to the pipe 14 via pressurized air guiding channels (not shown) formed in the downstream plate 34 so that the air chambers 51, 52 can be supplied with pressurized air. The third shim 33 is sandwiched between the second shim 32 and the downstream plate 34 to allow the air chambers 51, 52 to serve as pressurized air flow channels adapted to diffuse the pressurized air supplied from the pipe 14 in the cross direction CD and simultaneously to discharge such pressurized air toward the fibrous web 2. As will be apparent from FIGS. 1 and 3, the lower end 24 of the downstream plate 34 lies above the lower end 22 of the second shim 32 which is flush with the lower end 20 of the upstream plate 30, preferably at least 2 mm above the lower end 22 of the second shim 32. The third shim 33 is formed with a pressurized air discharging region 63 defined by the air chambers 51, 52 and the parts 53, 54, 55.

In the nozzle assembly 12 as has been described above, the upstream plate 30, the first shim 31, the second shim 32, the third shim 33 and the downstream plate 34 are assembled together using the bolts and the nuts to be held in close contact with one another in the machine direction MD. However, these bolts and nuts as well as the other means such as bolt holes are not shown in FIGS. 1 through 5 for simplification of drawings. The pipe 13 connected to the nozzle assembly 12 includes a heater and a pump necessary to supply the hot melt adhesive in molten state at a predetermined temperature under pressure. However, these heater and pump also are not shown in FIGS. 1 through 5. Preferably, the nozzle assembly 12 is connected to an air tank and provided with a heater so that the pressurized air may be heated until some given temperature if desired. However, these air tank and heater also are not shown in FIGS. 1 through 5. Preferably, the nozzle assembly 12 is provided with a heater so that the nozzle assembly may be temperature-adjustable partially or wholly.

In the process carried out by the illustrated embodiment of the coater 11 to coat the fibrous web with the hot melt adhesive 1, the nozzle assembly 12 cooperates with the fibrous web 2 in the manner as follows. The nozzle assembly 12 has first, second, third and fourth regions arranged in the machine direction MD in this order from the upstream toward the downstream and adapted to face the upper surface 2*a* of the fibrous web 2, successively. The first working region is defined by a contacting region 60 in which the nozzle assembly 12 comes in contact with the fibrous web 2, the second working region is defined by the adhesive discharging region 61, the third working region is defined by an intermediate region 62 and the fourth working region is defined by a pressurized air ejecting region 63. First, the supporting roller 16 and/or the supporting roller 17 are moved upward to press the upper surface 2*a* of the fibrous web 2 running below the nozzle assembly 12 in the machine direction MD against the contacting region 60 referred to herein as the first working region, i.e., against the lower end 20 of the upstream plate 30 so that the segment of the fibrous web 2 extending between the roller 16 and the roller 17 may be locally tightened over the entire width thereof in the machine direction MD and simultaneously also in the cross direction CD. In the adhesive discharging region 61 referred to herein as the second working region, the hot melt adhesive 1 in a molten state is supplied under pressure from the flow channels 41 of the first shim 31 to the upper surface 2*a* of the fibrous web 2 under tension so that the upper surface 2*a* of the fibrous web 2 may be linearly coated with the hot melt adhesive 1. In this step, the hot melt adhesive 1 would not move toward the upstream side since the upstream plate 30 is present on the upstream side of the lower ends of the respective flow channels 41. While an application quantity of the hot melt adhesive 1 to form each of the lines 18 may be regulated by factors such as a dimension of the flow channel 41 corresponding to the thickness of the first shim 31, a pressure-regulating valve integrated in the pipe 13 (not shown) and a discharge rate, a width of the respective lines 18 formed of the hot melt adhesive 1 as well as a distance between each pair of the adjacent lines 18 depends on design of the first shim 31 and can be therefore selectively set. The respective lines 18 of the hot melt adhesive 1 pass through the respective grooves 47 of the second shim 32, i.e., pass through the intermediate region 62 referred to herein as the third working region, then pass through under the air chamber 51 or the air chamber 52 of the third shim 33, i.e., pass through the pressurized air ejecting region 63 referred to herein as the fourth working region and finally pass under the downstream plate 34 in the machine direction MD. When the fibrous web 2 and the hot melt adhesive 1 run in this manner, there is a possibility that the hot melt adhesive 1 discharged from the respective flow channels and/or the hot melt adhesive 1 forming the lines 18 might be attached to and aggregated in the vicinity of the stepped regions 46 on the downstream side of the second shim 32. If the hot melt adhesive 1 aggregated in such a manner grows until it extends inside the grooves 47 and comes in contact with the hot melt adhesive 1 of the lines 18, the shape as well as the basis mass of the respective lines 18 might become uneven. However, it is possible for the nozzle assembly 12 according to the present invention to restrict movement of the hot melt adhesive 1 apt to be attached to and aggregate in the vicinity of the stepped regions 46 by ejection of pressurized air. In consequence, the width as well as the basis mass of the respective lines 18 can be maintained as uniform as possible.

The nozzle assembly 12 is adapted to, immediately before the fibrous web 2 is coated with the hot melt adhesive 1, press the fibrous web 2 over its entire width against the lower end 20 of the upstream plate 30 and thereby to tighten the fibrous web 2 in the machine direction MD as well as in the cross direction CD. Consequentially, even when thickness of the fibrous web 2 to be coated with the hot melt adhesive 1 is not uniform in the cross direction CD, for example, even when the fibrous web 2 made of non-woven fabric has in its middle region in the width direction thereof a separate non-woven fabric layer laminated on its lower surface 2*b* (See FIG. 1), it is relatively easy to form the upper surface 2*a* of the fibrous web 2 with the lines 18 well maintained uniform with respect to the width and the basis mass thereof not only individually but also across all the lines 18. If the fibrous web 2 is not pressed against the lower end 20 of the upstream plate 30 but against the lower end 21 of the first shim 31, the upper surface 2*a* of the fibrous web 2 under tension in the machine direction MD may sag upward in the respective flow channels 41 and sometimes may intrude into the respective flow channels as the width of the respective flow channels 41, i.e., the dimension of the respective flow channels 41 in the cross direction CD is enlarged. The lines 18 formed of the hot melt adhesive 1 discharged through the flow channel 41 having its width enlarged is apt to be instable with respect to its basis mass. In addition, it is difficult to maintain the basis mass of the hot melt adhesive 1 uniform between when the flow channels 41 having a relatively large width are used and when the flow channels 41 having a relatively smaller width are used. However, the nozzle assembly 12 according to the present invention overcomes such troubles. It should be understood here that the nozzle assembly 12 can regulate the positions of the supporting roller 16 and/or the supporting roller 17 in the height direction HD so that, when it is unnecessary to press the fibrous web 2 against the lower end 20 of the nozzle assembly 12, it is also possible to use the nozzle assembly 12 with the fibrous web 2 slightly spaced from the lower end 20 of the nozzle assembly 12. If ejection of the pressurized air in the fourth working region is unnecessary, the nozzle assembly 12 can be used with the ejection of the pressurized air being stopped. This is, for example, the case in which an application quantity of the hot melt adhesive 1 per unit time is relatively small or the case in which running velocity of the fibrous web 2 is relatively low.

In the illustrated embodiment of the nozzle assembly 12, the first, second and third shims 31, 32, 33 may be formed of a metallic plate which is extremely thin compared to the upstream plate 30 and the downstream plate 34. For example, the first, second and third shims 31, 32, 33 may be formed by partially trimming an iron plate having thickness in the range of 0.2 to 3 mm while the upstream plate 30 and the downstream plate 34 may be formed of an iron block having thickness in the range of 20 to 200 mm. In the nozzle assembly 12 using such an iron plate, various parameters such as the width and the interval of the lines 18 formed of the hot melt adhesive 1 can be changed quickly at low cost.

Figure 6:
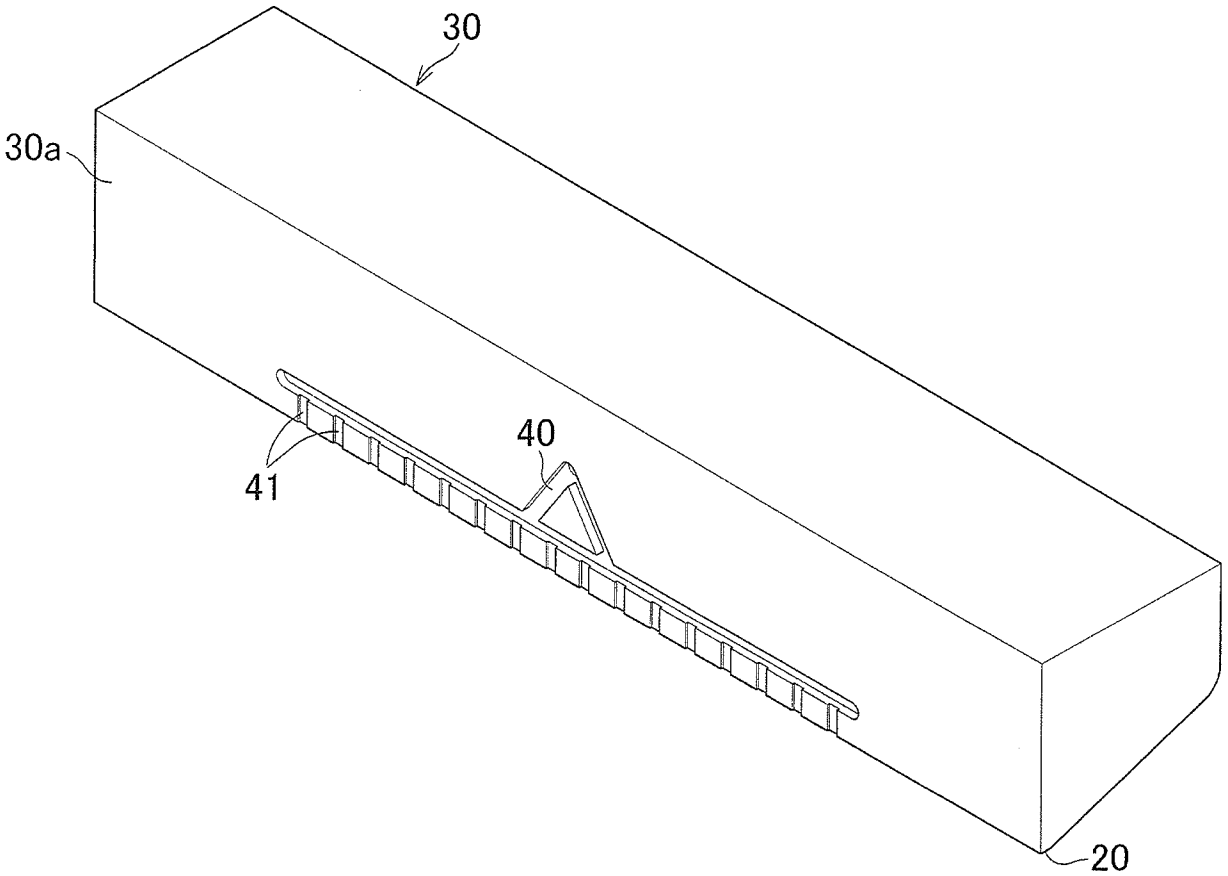
FIG. 6 is a perspective view exemplarily showing an upstream plate.

FIG. 6 is a perspective view exemplarily showing an upstream plate 30 which can be used in the present invention. It is possible to eliminate a first shim 31 by cutting flow channels 41 in an upstream plate 30 or a second shim 32 without departing from the scope of the invention. For example, flow channels 40 corresponding to the flow channels 40 indicated in FIG. 4 by imaginary lines and flow channels 41 corresponding to the flow channels 41 formed in the first shim 31 of FIG. 4 are formed in a surface 30*a* of the upstream plate 30 (See FIG. 3 also). The nozzle assembly 12 may use such upstream plate 30 and thereby eliminate the first shim 31. The upstream plate 30 in this embodiment is also formed with a contacting region 60 in which the fibrous web 2 is pressed against the upstream side of the flow channels 41.

Figure 7:
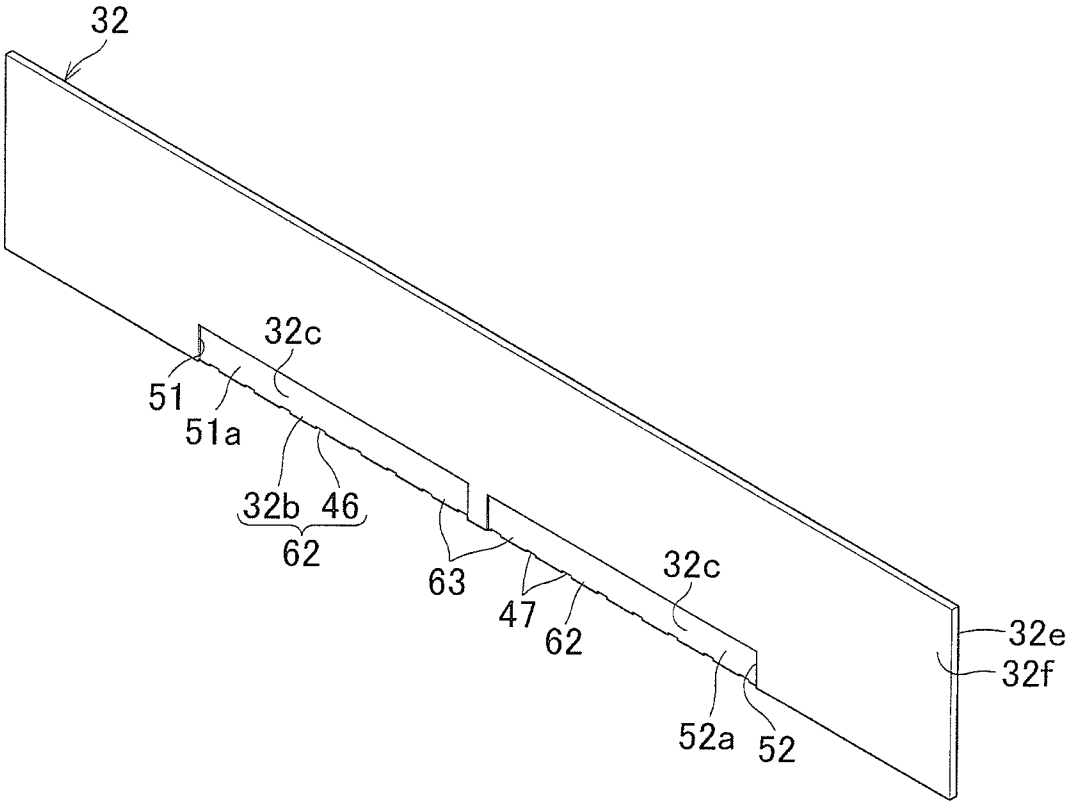
FIG. 7 is a perspective view exemplarily showing a second shim.

FIG. 7 is a perspective view showing a second shim 32 which can be used in the present invention. The second shim 32 has an upstream surface 32*e* held in close contact with a first shim 31 and a downstream surface 32*f* opposite to an upstream surface 32*e*. The surface 32*f* may be partially trimmed to form air chambers 51, 52 corresponding to those of FIG. 5 and these air chambers 51, 52 have a wall surface 32*c* which is parallel with the surface 32*f*. The surface 32*f* of the second shim 32 may be held in close contact with a downstream plate 34 of FIGS. 3 and 5 to form lower ends of the air chambers 51, 52 with openings 51*a*, 52*a* through which the pressurized air may be ejected toward the fibrous web 2. In such second shim 32, the air chambers 51, 52 cooperate with the surface 32*f* defining these air chambers 51, 52 to form a pressurized air ejecting region 63 corresponding to the pressurized air ejecting region 63 shown in FIG. 5. In the second shim 32 also, a portion defined between the upstream surface 32*e* and the wall surface 32*c* which is formed in the same manner as in the second shim 32 of FIG. 4. Thus, the second shim 32 has second partitioning regions 32*b* and stepped regions 46 defining grooves 47 and an intermediate region 62. In the nozzle assembly 12 using such second shim 32, the third shim 33 of FIGS. 3 and 5 can be eliminated.

Without departing from the scope of the invention, it is possible to replace the hot melt adhesive 1 used in the illustrated embodiment by solvent adhesives or the other type of adhesives. Furthermore, in addition to a non-woven fabric, there are various types of sheet materials which may be used as the fibrous web 2 such as a woven fabric, paper or a plastic film. In addition, the number of the lines 18 of the hot melt adhesive 1 formed on the fibrous web 2 is not limited to a plurality of lines as in the illustrated embodiment, but it is also possible to form a single line 18 of the hot melt adhesive 1 on the fibrous web 2, if desired.

REFERENCE SIGNS LIST

1 adhesives
2 fibrous web
2*a* upper surface
11 coater
12 nozzle (nozzle assembly)
18 lines
20 lower end
21 end face (end)
22 end face (end)
30 first plate (upstream plate)
31 first shim
31*b* first partitioning regions
32 second shim
32*b* second partitioning regions
33 third shim
34 second plate (downstream plate)
41 flow channels
43 ends, outlets
46 stepped sections
46*a* surface (top surface)
51 flow channels
52 flow channels
51*a* end, outlet (opening)
52*a* end, outlet (opening)
60 first working region (contacting region)
61 second working region (adhesive discharging region)
62 third working region (intermediate region)
63 fourth working region (pressurized air ejecting region)
CD cross direction
MD machine direction

The invention claimed is:

1. A nozzle assembly comprising:

a series of plurality of nozzles configured to be incorporated in an adhesive coater to form one or more adhesive lines extending in a machine direction on an upper surface of a fibrous web continuously running in the machine direction, the fibrous web having a length direction corresponding to the machine direction and a width direction corresponding to a cross direction orthogonal to the machine direction;

first, second, third, and fourth working regions arranged in the recited order from upstream to downstream in the machine direction, and on a side facing the upper surface of the fibrous web; and a first plate, a first shim, a second shim, a third shim and a second plate arranged separately in close contact with one another in the recited order from upstream to downstream in the machine direction, wherein the first working region is configured to be pressed against the fibrous web fully in the width direction, the second working region is configured to discharge adhesives and includes a plurality of first partitioning regions arranged intermittently in the cross direction, and a plurality of adhesive outlets each defined between a pair of adjacent first partitioning regions among the plurality of first partitioning regions, wherein the adhesive outlets are located corresponding to the adhesive lines to be formed in the machine direction, and respective end surfaces of the first partitioning regions are flush with the first working region, the third working region includes a plurality of second partitioning regions arranged intermittently in the cross direction and downstream of the first partitioning regions, and stepped regions each arranged between a pair of adjacent second partitioning regions among the plurality of second partitioning regions so that the second partitioning regions and the stepped regions are alternately arranged in the cross direction, wherein respective end surfaces of said second partitioning regions are configured to face the upper surface of the fibrous web and are flush with the first working region as well as with the end surfaces of the first partitioning regions, and a surface of the stepped regions configured to face the upper surface of the fibrous web is spaced upward at least 0.1 mm from the flush end surfaces of the first and second partitioning regions, and the fourth working region is configured to eject pressurized air and is located downstream of the second partitioning regions and the stepped regions, and the fourth working region has pressurized air outlets from which the pressurized air is to be ejected toward the upper surface of the fibrous web, the first plate defines the first working region, the first shim defines the first partitioning regions and adhesive flow channels for the adhesives, the first shim is formed of a metal plate, and the first shim cooperates with the first plate and the second shim both held in close contact with the first shim to define the adhesive outlets at respective ends of the adhesive flow channels, the third shim defines pressurized air flow channels for the pressurized air, the third shim is formed of a metal plate, and the third shim cooperates with the second shim and the second plate both held in close contact with the third shim to define the pressurized air outlets at respective ends of the pressurized air flow channels, the first plate further defines an adhesive guiding channel adapted to guide the adhesives from outside of the nozzle assembly into the adhesive flow channels, and the second plate defines a pressurized air guiding channel adapted to guide the pressurized air from outside of the nozzle assembly into the pressurized air flow channels.

2. A nozzle assembly comprising:

a series of plurality of nozzles configured to be incorporated in an adhesive coater to form one or more adhesive lines extending in a machine direction on an upper surface of a fibrous web continuously running in the machine direction, the fibrous web having a length direction corresponding to the machine direction and a width direction corresponding to a cross direction orthogonal to the machine direction;

first, second, third, and fourth working regions arranged in the recited order from upstream to downstream in the machine direction, and on a side facing the upper surface of the fibrous web; and a first plate, a shim and a second plate arranged separatably in close contact with one another in the recited order from upstream to downstream in the machine direction, wherein the first working region is configured to be pressed against the fibrous web fully in the width direction, the second working region is configured to discharge adhesives and includes a plurality of first partitioning regions arranged intermittently in the cross direction, and a plurality of adhesive outlets each defined between a pair of adjacent first partitioning regions among the plurality of first partitioning regions, wherein the adhesive outlets are located corresponding to the adhesive lines to be formed in the machine direction, and respective end surfaces of the first partitioning regions are flush with the first working region, the third working region includes a plurality of second partitioning regions arranged intermittently in the cross direction and downstream of the first partitioning regions, and stepped regions each arranged defined between a pair of adjacent second partitioning regions among the plurality of second partitioning regions so that the second partitioning regions and the stepped regions are alternately arranged in the cross direction, wherein respective end surfaces of said second partitioning regions are configured to face the upper surface of the fibrous web and are flush with the first working region as well as with the end surfaces of the first partitioning regions, and a surface of the stepped regions configured to face the upper surface of the fibrous web is spaced upward at least 0.1 mm from the flush end surfaces of the first and second partitioning regions, and the fourth working region is configured to eject pressurized air and is located downstream of the second partitioning regions and the stepped regions, and the fourth working region has pressurized air outlets from which the pressurized air is to be ejected toward the upper surface of the fibrous web, the first plate defines the first working region;

the shim defines the third working region, adhesive flow channels, and pressurized air flow channels, the first plate and the shim are held in close contact with each other to define the adhesives outlets, the second plate and the shim are held in close contact with each other to define the pressurized air outlets, the first plate further defines an adhesive guiding channel adapted to guide the adhesive from outside of the nozzle assembly into the adhesive flow channels, and the second plate defines a pressurized air guiding channel adapted to guide the pressurized air from outside of the nozzle assembly into the pressurized air flow channels.

* * * * *